US011842578B2

(12) United States Patent
Im

(10) Patent No.: US 11,842,578 B2
(45) Date of Patent: Dec. 12, 2023

(54) VEHICLE SAFETY COMPONENT DIAGNOSIS APPARATUS

(71) Applicant: GLOBIZ CO., LTD., Seoul (KR)

(72) Inventor: Jun Sik Im, Seoul (KR)

(73) Assignee: GLOBIZ CO., LTD., Seoul (KR)

( * ) Notice: Subject to any disclaimer, the term of this patent is extended or adjusted under 35 U.S.C. 154(b) by 46 days.

(21) Appl. No.: 16/727,681

(22) Filed: Dec. 26, 2019

(65) Prior Publication Data

US 2021/0201602 A1 Jul. 1, 2021

(51) Int. Cl.
*G07C 5/08* (2006.01)

(52) U.S. Cl.
CPC ..... *G07C 5/08* (2013.01)

(58) Field of Classification Search
CPC ..... G07C 5/08
See application file for complete search history.

(56) References Cited

U.S. PATENT DOCUMENTS

| | | | | |
|---|---|---|---|---|
| 2008/0114240 | A1* | 5/2008 | Sasaki | A61B 8/06 600/440 |
| 2017/0276052 | A1* | 9/2017 | Monna | F01N 11/007 |
| 2020/0026435 | A1* | 1/2020 | Satou | G06F 3/0673 |

FOREIGN PATENT DOCUMENTS

| | | | | |
|---|---|---|---|---|
| CN | 104835499 | * | 2/2018 | G10L 19/02 |
| CN | 108885237 | * | 11/2018 | H02S 50/00 |
| JP | 2011-185727 | * | 9/2011 | G07C 5/0808 |
| JP | 2011-185727 A | | 9/2011 | |
| JP | WO 2016021485 | * | 2/2016 | G08C 17/00 |
| KR | 10-1571485 B1 | | 11/2015 | |
| KR | 101645297 | * | 8/2016 | B60K 17/30 |
| KR | 10-2016-0103734 A | | 9/2016 | |
| KR | 101752298 | * | 6/2017 | G01M 15/12 |
| KR | 10-2017-0131792 A | | 11/2017 | |

* cited by examiner

*Primary Examiner* — Alexander Satanovsky
(74) *Attorney, Agent, or Firm* — Paratus Law Group, PLLC

(57) ABSTRACT

The present disclosure relates to a vehicle safety component diagnosis apparatus that includes: a vehicle state summarizer summarizing a vehicle state on the basis of sensing values collected from a plurality of sensors for a specific period; a vehicle state distribution calculator calculating distribution about summary of a vehicle state for a plurality of specific periods; an abnormal safety component detector detecting an abnormal safety component by determining an abnormal situation about a specific sensing value through the distribution of the summary of the vehicle state; and a precise diagnosis performer performing precise diagnosis about the abnormal safety component. Therefore, according to the present disclosure, it is possible to diagnose defects of safety components using sensing values collected from a plurality of sensors.

10 Claims, 10 Drawing Sheets

VEHICLE SAFETY COMPONENT DIAGNOSIS APPARATUS

BACKGROUND

Field of the Invention

The present disclosure relates to a vehicle safety component diagnosis apparatus and, more particularly, to a vehicle safety component diagnosis apparatus that can diagnose a defect of a safety component using sensing values collected from a plurality of sensors.

Related Art

At present, automotive self diagnosis apparatuses are limited only to sensors of a control system or the parts of an engine control device needed for measuring exhaust gas. That is, if a sensor is not normal in a control system, control itself is impossible, so sensors are generally examined in an ABS (anti-skid braking system), a TCS (traction control system), and a posture control system.

Since the rules on exhaust gas are very severe, an alarming device that informs a driver of a problem when the problem is generated by performing self diagnosis on sensors or exhaust gas measurers for satisfying the rules about exhaust gas in a control device for an engine system has been set by law.

However, though many of automotive safety components are components that have a high possibility of causing a fatal accident when a defect is generated, they are little monitored or diagnosed.

Recently, since it was found that the possibility of a rollover accident increases when the air pressure of a tire decreases, devices that monitor the air pressure of tires have been set by law and laws have been enforced over the world.

Further, as many accidents are caused by sudden start of a vehicle and defects in a vehicle, there is a need for a technology that can monitor and diagnose automotive defects more effectively in a wide range.

Meanwhile, diagnosis methods for diagnosis targets have been developed in various industrial fields. The possibility of a defect of a diagnosis target can be checked through heat, sound, vibration, etc. A diagnosis method using heat or sound enables a user to easily recognize a defect of a diagnosis target, but the user can recognize the defect of the diagnosis target even after the defect of the diagnosis target considerably progresses. A diagnosis method using vibration can most quickly predict the possibility of a defect in a diagnosis target, so diagnosis methods using vibration were generally used in the related art.

However, in order to use the diagnosis methods using vibration, it is required to set a sampling time of data very short and collect data, so the amount of data is too much and there is a need for a memory having very large capacity. Further, frequency change was required to analyze measured data, so a memory resource for various items of calculation was excessively increased.

However, since vehicles have limited memory resources, it was difficult to perform respective diagnosis methods for various automotive components. Further, when a diagnosis server outside a vehicle needs to perform respective diagnosis methods for various automotive components, it is required to transmit data from the vehicle to the diagnosis server, but there is a problem that the amount of data that has to be transmitted is too much. Accordingly, it was very difficult to implement respective diagnosis methods for various automotive components through a diagnosis sever outside a vehicle.

Further, since vehicles are transportation, the data measured from the vehicles are influenced by disturbance, which deteriorates the reliability in diagnosis of automotive components.

This background is provided to help understand the background of the present disclosure and may include matters that are not the related art known to those skilled in the art.

SUMMARY

An embodiment of the present disclosure provides a vehicle safety component diagnosis apparatus that can diagnose a defect of a safety component using sensing values collected from a plurality of sensors.

An embodiment of the present disclosure provides vehicle safety component diagnosis apparatus that can determine abnormality of a safety component through distribution of index values for a plurality of diagnosis items constituting a vehicle state.

An embodiment of the present disclosure provides vehicle safety component diagnosis apparatus that can precisely diagnose a defect of a safety component through comparison and analysis in a frequency domain by sampling sensing values collected for the entire cycle.

In embodiments, a vehicle safety component diagnosis apparatus includes: a vehicle state summarizer summarizing a vehicle state on the basis of sensing values collected from a plurality of sensors for a specific period; a vehicle state distribution calculator calculating distribution about summary of a vehicle state for a plurality of specific periods; an abnormal safety component detector detecting an abnormal safety component by determining an abnormal situation about a specific sensing value through the distribution of the summary of the vehicle state; and a precise diagnosis performer performing precise diagnosis about the abnormal safety component.

The vehicle state summarizer may summarize the vehicle state by calculating index values respectively for a plurality of diagnosis items constituting the vehicle state using the sensing values collected from the specific period.

The vehicle state distribution calculator may create a multi-dimensional coordinate system composed of coordinate axes respectively corresponding to the plurality of diagnosis items, and may calculate distribution about a plurality of index values for the plurality of specific periods in the multi-dimensional coordinate system.

The abnormal safety component detector may determine a first safety standard for coordinate axes on the basis of distribution about a plurality of index values in a multi-dimensional coordinate system and may determine a safety component related to a diagnosis item corresponding to a corresponding axis as an abnormal safety component when there is an index value out of the first safety standard.

When a specific number of index values related to the corresponding coordinate axis and being out of the first safety standards are distributed in specific continuous periods, the abnormal safety component detector may determine a safety component related to a diagnosis item corresponding to the corresponding coordinate axis as an abnormal safety component.

The precise diagnosis performer may calculate precise diagnosis indexes through any one of envelope analysis and Fast Fourier Transform (FFT) on the basis of sensing values collected for a specific period for sensors related to abnormal safety components.

The precise diagnosis performer may determine second safety standards on the basis of the precise diagnosis index for the plurality of specific periods, and may diagnose a defect of the abnormal safety component by comparing the second safety standards with the precise diagnosis index.

The precise diagnosis performer may determine that there is a defect in the abnormal safety component when the precise diagnosis index repeatedly exceeds the second safety standards for a specific number of specific continuous periods.

Meanwhile, the first safety standards may be determined on the basis of distribution about index values and the index values may be calculated on the basis of sensing values in a time domain at every first cycle; the second standards may be determined on the basis of distribution of precise diagnosis indexes and the precise diagnosis indexes may be calculated on the basis of sensing values in a frequency domain at every second cycle longer than the first cycle; and a first sampling cycle of the sensing values for calculating the index values may be longer than a second sampling cycle of the sensing values for calculating the precise diagnosis indexes.

DETAILED DESCRIPTION

Figure 1:
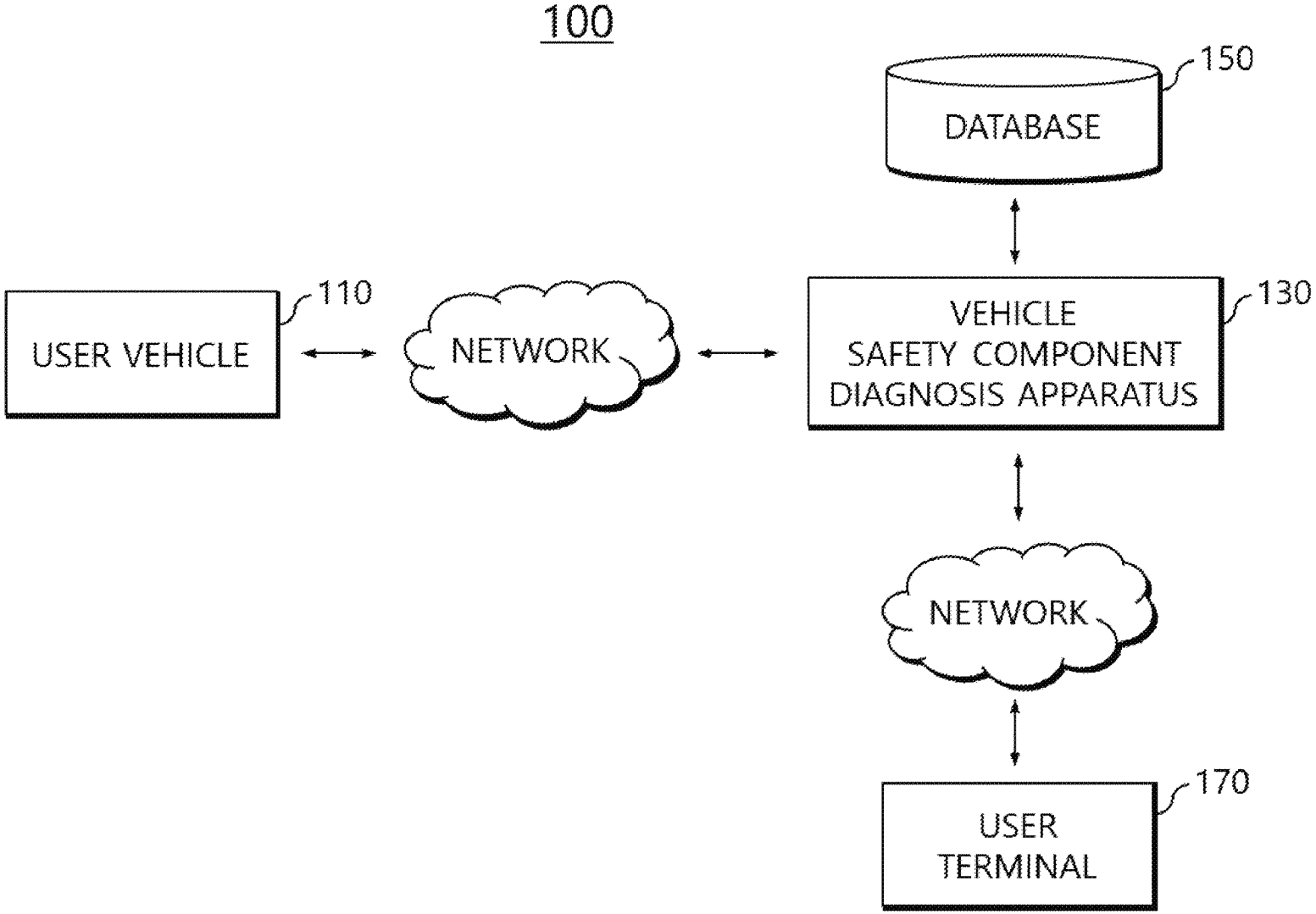
FIG. 1 is a diagram illustrating a vehicle safety component diagnosis system according to an embodiment of the present disclosure.

The description in the present disclosure is only embodiments for structural and functional description, so the scope of a right of the present disclosure should not be construed as being limited by the embodiments described herein. That is, embodiments may be changed and modified in various ways, so the scope of a right of the present disclosure should be understood as including equivalents that can achieve the spirit of the present disclosure. Further, the objects or effects proposed herein do not mean that the objects or effects should be all included in a specific embodiment or only the effects should be included in a specific embodiment, so the scope of a right of the present disclosure should not be construed as being limited by the objects or effects.

Meanwhile, terms used herein should be understood as follows.

Terms "first", "second", etc. are provided for discriminating one component from another component and the scope of a right is not limited to the terms. For example, the first component may be named the second component, and vice versa.

It is to be understood that when one element is referred to as being "connected to" another element, it may be connected directly to another element or be connected to another element, having the other element intervening therebetween. On the other hand, it is to be understood that when one element is referred to as being "connected directly to" another element, it may be connected to or coupled to another element without the other element intervening therebetween. Meanwhile, the terms used herein to describe a relationship between elements, that is, "between", "directly between", "adjacent" or "directly adjacent" should be interpreted in the same manner as those described above.

Singular forms should be understood as including plural forms unless the context clearly indicates otherwise, and it will be further understood that the terms "comprises" or "have" used in this specification, specify the presence of stated features, steps, operations, components, parts, or a combination thereof, but do not preclude the presence or addition of one or more other features, numerals, steps, operations, components, parts, or a combination thereof.

In each step, reference characters (e.g., a, b, and c) are used for convenience without determining the order of each step, and each step may occur different from the orders described herein unless specific orders are clearly described in contexts. That is, each step may occur in the order described herein, may be substantially simultaneously performed, or may be performed in a reverse order.

The present disclosure may be achieved as computer-readable codes in a computer-readable recording medium and the computer-readable recording medium includes all kinds of recording devices in which data that can be read out by a computer system are stored. The computer-readable recording medium, for example, may be a ROM, a RAM, a CD-ROM, a magnetic tape, a floppy disk, an optical data storage device, etc. Further, the computer-readable recording media may be distributed to computer systems that are connected through a network and may store and execute computer-readable codes in the type of distribution.

Unless otherwise defined, all terms used herein have the same meaning as commonly understood by those skilled in the art to which the present disclosure belongs. It will be further understood that terms defined in dictionaries that are commonly used should be interpreted as having meanings that are consistent with their meanings in the context of the relevant art and will not be interpreted in an idealized or overly formal sense unless expressly so defined herein.

As used in this specification, terms "vehicle", "vehicular", or other terms are understood as including vehicles, passenger automobiles generally including sports utility vehicles (SUV), buses, trucks, various commercial vehicles, various boats, ships, vessels, airplanes, etc., and including hybrid vehicles, electric vehicles, hybrid electric vehicles, hydrogen vehicles, and other vehicles using alternative fuel (fuel obtained from resources other than oil). As stated in this specification, an electric vehicle (EV) including electric power obtained from a chargeable energy storage device (e.g., one or more rechargeable electrochemical cells or other types of batteries) as a part of its locomotive capabilities. An EV is not limited to a vehicle and may include motor cycles, carts, and scooters. Further, a hybrid vehicle is a vehicle having two or more power sources, for example, gasoline-based power and electricity-based power (e.g., a hybrid electric vehicle (HEV)).

Unless otherwise defined, all terms used herein have the same meaning as commonly understood by those skilled in the art to which the present disclosure belongs. It will be further understood that terms defined in dictionaries that are commonly used should be interpreted as having meanings that are consistent with their meanings in the context of the relevant art and will not be interpreted in an idealized or overly formal sense unless expressly so defined herein.

FIG. 1 is a diagram illustrating a vehicle safety component diagnosis system according to an embodiment of the present disclosure.

Referring to FIG. 1, a vehicle safety component diagnosis system 100 includes a vehicle 110, a vehicle safety component diagnosis apparatus 130, a database 150, and a user terminal 170.

The vehicle 110, which is a transportation that carries passengers or freights using power produced by an engine, may correspond to a car. The vehicle 110 may include not only a car, but a ship, an airplane, etc., but is not necessarily limited thereto and may include various transportations that can move using power.

In an embodiment, the vehicle 110 may include a plurality of sensors that can measure relevant data to monitor the states of various components. For example, the vehicle 110 may include an accelerator pedal sensor, a brake pedal sensor, a timing belt vibration sensor, a wheel acceleration sensor, a car body acceleration sensor, a car body inclination angle sensor, a car body vibration sensor, a GPS (Global Positioning System) sensor, a flowmeter, an engine RPM sensor, a vehicle speed sensor, a knuckle vibration sensor, a steering angle sensor, etc.

The vehicle safety component diagnosis apparatus 130 may be implemented as a computer or a server corresponding to a program that can diagnose in advance a defect of safety components constituting a vehicle. In this case, the safety components may correspond to components that can influence safety of a vehicle and passengers when a defect is generated in the components of a vehicle. The vehicle safety component diagnosis apparatus 130 can be wirelessly connected with the vehicle 110 through Bluetooth, Wi-Fi, etc., and can exchange data with the vehicle 110 through a network.

In an embodiment, the vehicle safety component diagnosis apparatus 130 can receive sensing values periodically or in real time from a plurality of sensors included in the user vehicle 110, and can diagnose abnormal situations or defects of safety components and provide the result to the vehicle 110. In another embodiment, the vehicle safety component diagnosis apparatus 130 may be included in the vehicle 110.

The vehicle safety component diagnosis apparatus 130 may include the database 150 or may be implemented independently from the database 150. When independently implemented from the database 150, the vehicle safety component diagnosis apparatus 130 is connected with the database 150 through wire or wirelessly, thereby being able to exchange data.

The database 150 is a storage device that can store various items of information for diagnosing vehicle safety components. The database 150 can store information about the vehicle 110 and various safety components constituting the vehicle 110 and can store a plurality of sensing values received from the vehicle 110. However, the database 150 is not necessarily limited thereto and may store information collected and processed in various types in the process of diagnosing vehicle safety components on the basis of a plurality of sensing values. For example, the database 150 can store information about an engine state, a fuel state, a cooling water state, an engine oil state, a vehicle speed, a remaining amount of fuel, battery voltage, engine torque, fuel efficiency, a driving distance, gear position, external air temperature, etc. on the basis of a plurality of sensing values received from the vehicle 110.

The database 150 may be composed of at least one or more independent sub-databases storing information pertaining to a specific range and may be an integrated database in which the independent sub-databases are integrated. When the database 150 is composed of at least one or more independent sub-databases, the sub-databases may be connected wirelessly through Bluetooth, WiFi, etc., and can exchange heat with each other through a network. When the database 150 is an integrated database, it may include a controller that integrates the sub-databases and manages data exchange and control flow between them.

The user terminal 170 may correspond to a computing device that can receive results of diagnosing safety components performed by the vehicle safety component diagnosis apparatus 130 and can display the results through various interfaces. The user terminal 170 may be a smartphone, a notebook, or a computer, but is not limited thereto and may be various devices such as a tablet PC. The user terminal 170 may be connected with the vehicle safety component diagnosis apparatus 130 through a network and a plurality of user terminals 170 may be all connected with the vehicle safety component diagnosis apparatus 130. In an embodiment, the user terminal 170 may be registered in advance on the vehicle 110 and/or the vehicle safety component diagnosis apparatus 130.

Figure 2:
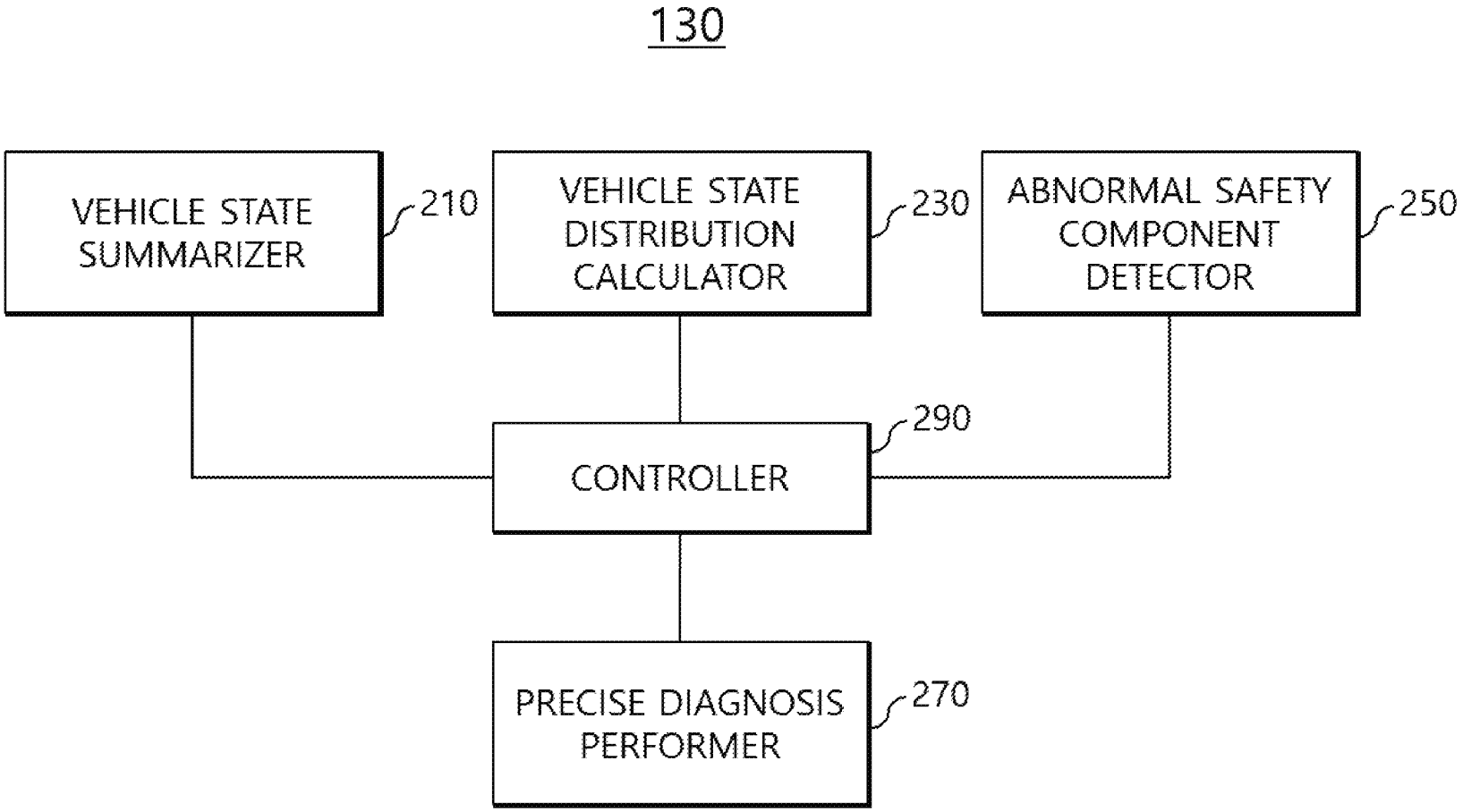
FIG. 2 is a block diagram illustrating a vehicle safety component diagnosis apparatus shown in FIG. 1.

FIG. 2 is a block diagram illustrating a vehicle safety component diagnosis apparatus shown in FIG. 1.

Referring to FIG. 2, the vehicle safety component diagnosis apparatus 130 may include a vehicle state summarizer 210, a vehicle state distribution calculator 230, an abnormal safety component detector 250, a precise diagnosis performer 270, and a controller 290.

The vehicle state summarizer 210 can summarize a vehicle state on the basis of sensing values collected for a specific period from a plurality of sensors. In this case, summarizing a vehicle space may mean integrate various items of information so that the current state of the vehicle 110 can be easily found out. For example, the vehicle state summarizer 210 can simply arrange a vehicle state by summarizing sensing values received for a predetermined period from a plurality of sensors included in the vehicle 110 into index values for diagnosis items.

In an embodiment, the vehicle state summarizer 210 can summarize a vehicle state by calculating index values for a plurality of diagnosis items constituting a vehicle state using sensing values collected for a specific period. In this case, the specific period may be a time period for collecting sensing values and the diagnosis items may diagnosis targets corresponding to safety components of the vehicle. The specific period and the diagnosis items may be set in advance or automatically by the vehicle safety component diagnosis apparatus 130.

The diagnosis items may include diagnosis points and at least one diagnosis parameter in accordance with the types of the diagnosis items. For example, the types of the diagnosis items may include engine overheating, a ball joint over gap, a fixed quantity of refueling, sudden start, a driving shaft, a wheel bearing, wheel unbalance, a brake judder, a damper, a timing belt, and wheel alignment, but are not necessarily limited thereto and may include various diagnosis items that can be used for safety component diagnosis.

The kinds of diagnosis items each may include the following diagnosis points and at least one parameter (but, diagnosis item: diagnosis point (diagnosis parameter)).

1) Engine overheating: engine temperature (engine RPM, vehicle speed, accelerator pedal angle, external air temperature)
2) Ball joint over gap: double integral value [knuckle vibration–car body vibration] (vehicle speed, acceleration/deceleration)
3) Fixed quantity of refueling: refueling amount [final fuel amount–initial fuel amount] (initial amount of fuel, GPS)
4) Sudden start: acceleration [differentia value of vehicle speed] (vehicle speed, angle of accelerator pedal, engine RPM)
5) Driving shaft: knuckle vibration (engine RPM, vehicle speed, steering angle)
6) Wheel bearing: knuckle vibration (engine RPM, vehicle speed, angle of accelerator pedal)
7) Wheel unbalance: knuckle vibration (engine RPM, vehicle speed, angle of accelerator pedal)
8) Brake judder: knuckle vibration (engine RPM, vehicle speed, deceleration) Damper: [car body vibration–knuckle vibration] (steering angle, vehicle speed, acceleration/deceleration)
9) Timing belt: timing belt vibration [or engine vibration] (engine RPM, vehicle speed, angle of accelerator pedal)
10) Wheel alignment: transverse vibration of wheel (engine RPM, vehicle speed)

When the diagnosis item is engine overheating and the driving distance of the vehicle is larger than a set driving distance, the vehicle safety component diagnosis apparatus 130 can diagnose this case as engine overheating and can collect actual engine temperature at the engine RPM, vehicle speed, and accelerator pedal angle measured by sensors as vehicle state information.

When the diagnosis item is an over gap of a ball joint, the vehicle safety component diagnosis apparatus 130 can diagnose this case as an over gap of a ball joint with the brake pedal on and the accelerator pedal off or can diagnose this case as an over gap of a ball joint with the brake pedal off and the accelerator pedal on. The diagnosis parameters with the brake pedal on and the accelerator pedal off are vehicle speed and deceleration, and the diagnosis parameters with the brake pedal off and the accelerator pedal on are vehicle speed and acceleration.

When the diagnosis item is a fixed quantity of refueling, the vehicle safety component diagnosis apparatus 130 can diagnose this case as a fixed quantity of refueling when an engine is stopped and then started and the difference between the initial amount of fuel at the point in time at which the engine is stopped and the final amount of fuel at the point in time at which the engine is stopped again is a set value or more. When the diagnosis item is sudden start, the vehicle safety component diagnosis apparatus 130 can diagnose this case as sudden start with the brake pedal on and the acceleration larger than 0.

When the diagnosis item is wheel unbalance, the vehicle safety component diagnosis apparatus 130 can perform diagnosis with the brake pedal off. When the diagnosis item is a brake judder, vehicle safety component diagnosis apparatus 130 can perform diagnosis with the brake pedal on and the accelerator pedal off. When the diagnosis item is a timing belt, the vehicle safety component diagnosis apparatus 130 can perform diagnosis with the brake pedal off. When the diagnosis item is wheel alignment, the vehicle safety component diagnosis apparatus 130 can perform diagnosis with the brake pedal off.

The vehicle state summarizer 210 can collect various sensing values from a plurality of sensors for a specific period, and can use all the collected sensing values or sample and use only some of the sensing values. The collection cycle or the sampling cycle of the sensing values may be set in advance or automatically by the vehicle safety component diagnosis apparatus 130.

The vehicle state summarizer 210 can determine diagnosis points and indexes of diagnosis parameters for the kinds of the diagnosis items, and can calculate index values for the diagnosis items using index information collected for a specific period. In this case, the index may be a step in which a measured specific sensing value is included when the measurement range of sensing values that are collected from sensors are classified into predetermined levels, and the index value may be a value that is calculated using the index information collected for a specific period and represents a corresponding specific period.

Figure 4:
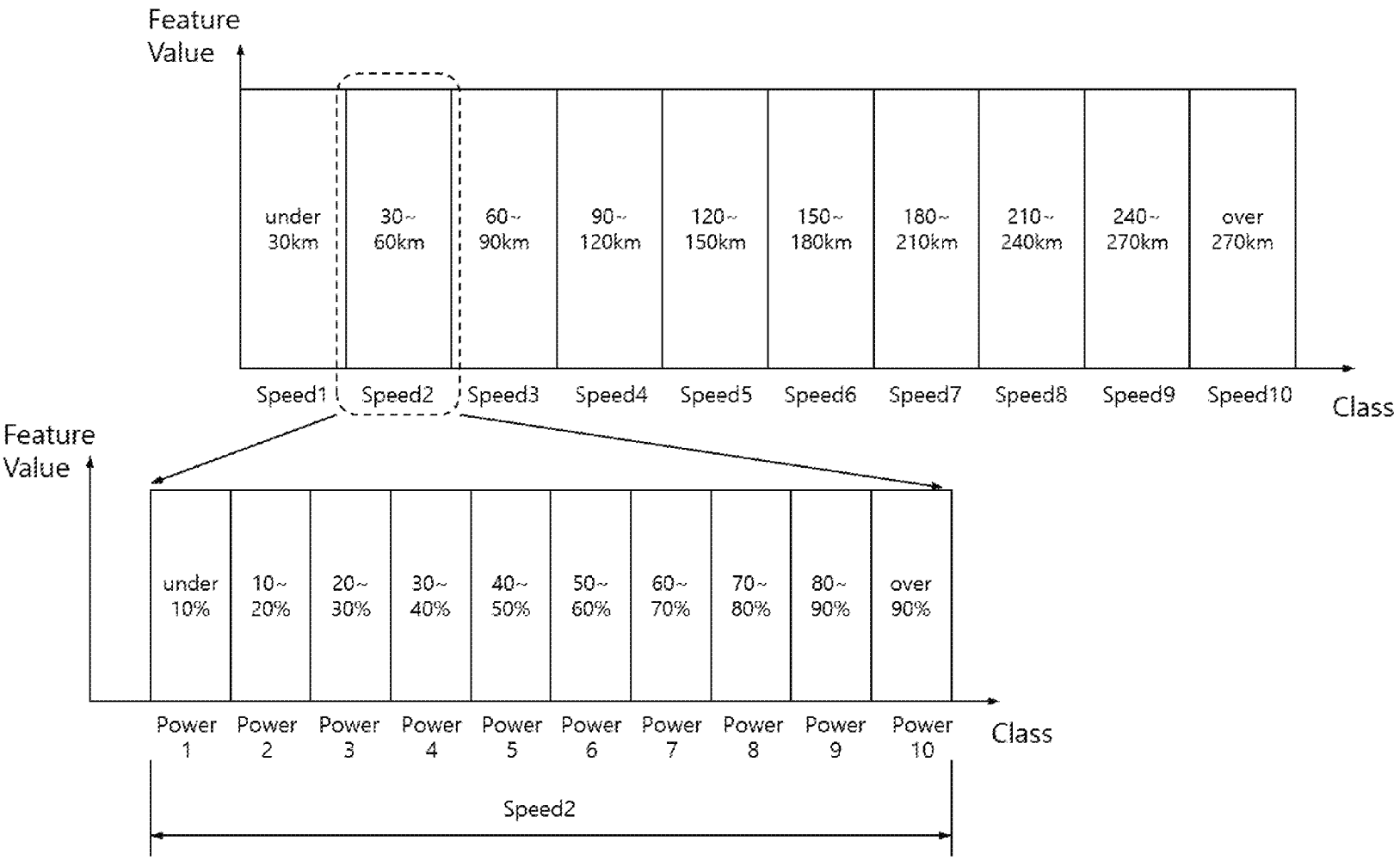
FIGS. 4 to 7 are exemplary views illustrating a process of determining an index for a diagnosis point using an index for a diagnosis parameter in the vehicle safety component diagnosis apparatus shown in FIG. 1.
Figure 5:
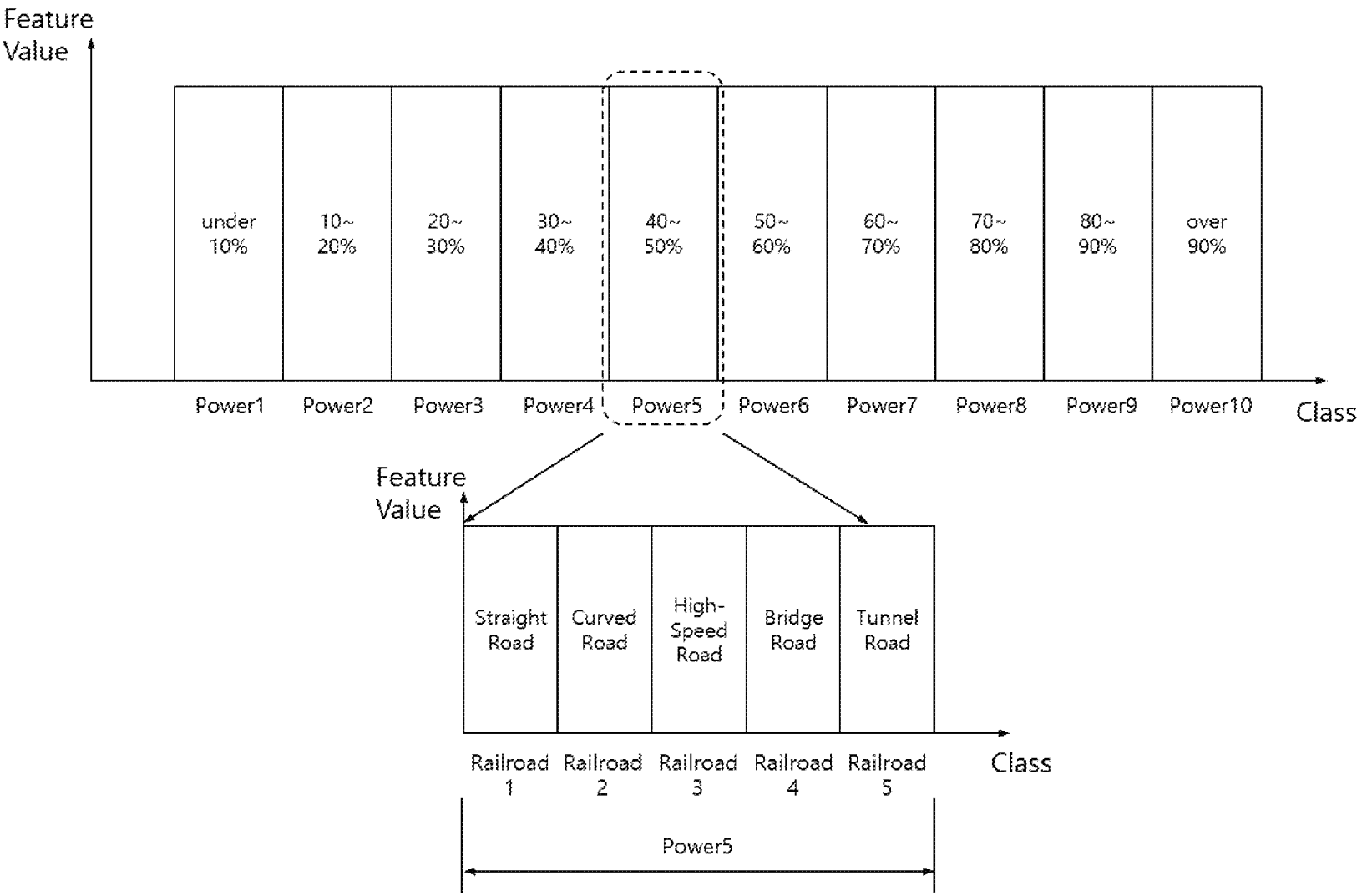
Figure 6:
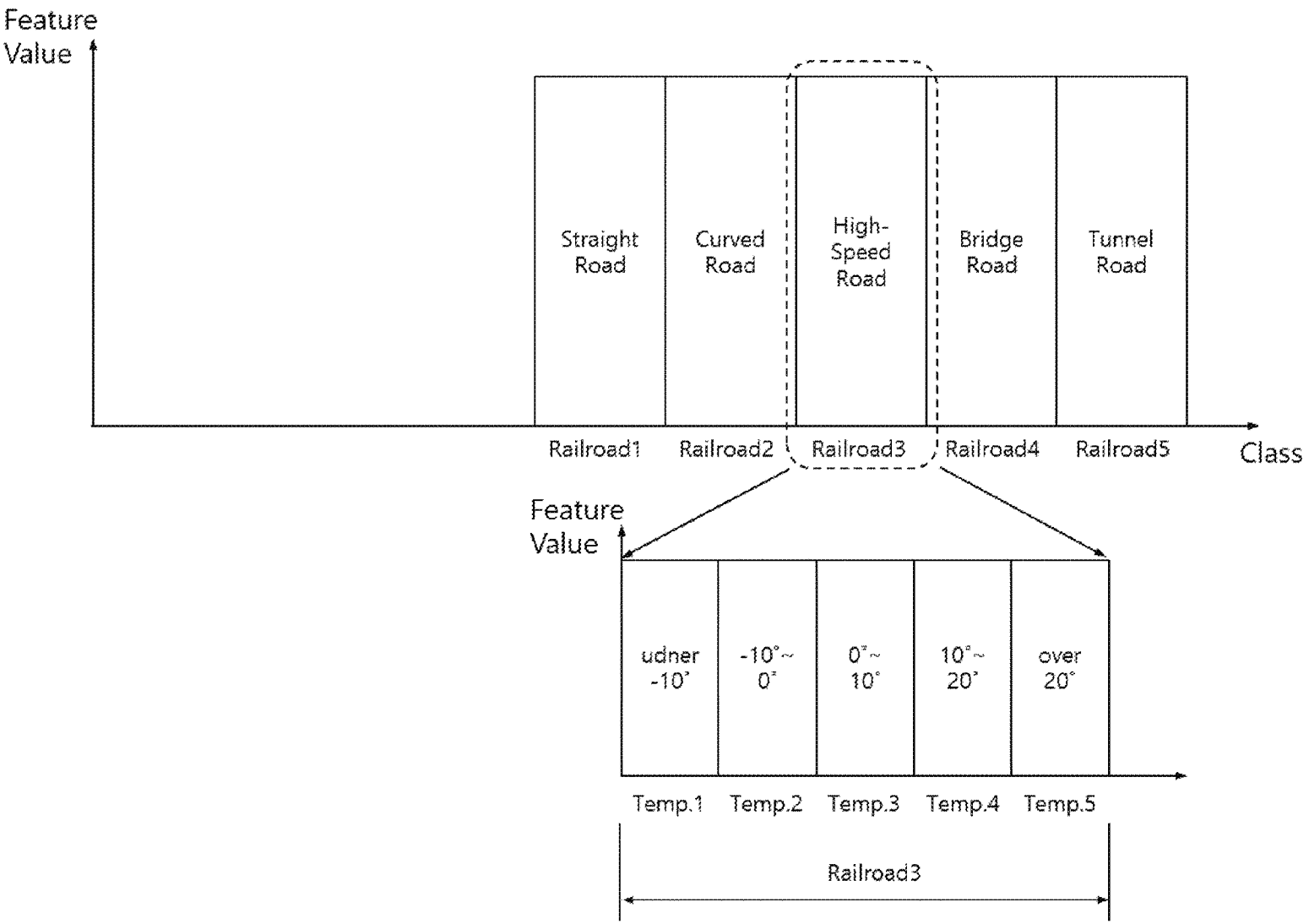

For example, the vehicle state summarizer 210 calculates an index value for engine overheating that is one of the diagnosis items on the basis of sensing values collected for a predetermined period, and this process is as follows.

a) Sensing values are collected from respectively corresponding sensors for an engine RPM, vehicle speed, and an accelerator pedal angle that are diagnosis parameters constituting engine temperature that is a diagnosis point.
b) When the engine RPM is 230 RPM, the vehicle speed is 35 km/h, and the accelerator pedal angle is 15$_i$Æ, the index of the engine RPM, the index of the vehicle speed, and the index of the accelerator pedal angle are respectively determined as 2, 3, and 1 (but, the engine RPM 230 RPM corresponds to a second level of an RPM range, the vehicle speed 35 km/h corresponds to a third level of a speed range, and the accelerator pedal angle 15$_i$Æ corresponds to a second level of an angle range).
c) An index of engine temperature that is a diagnosis point of engine overheating is determined on the basis of the index information calculated for the diagnosis parameters (but, the detailed process will be described in more detail with reference to FIGS. 4 to 6).
d) An index value for engine overheating is calculated using the index information for the engine temperature for a specific period (here, the index value may correspond any one of an average $$\left(\bar{x} = \sum_{i=1}^{N} x(i)/n\right),$$

a peak $$\left(\frac{1}{2}[\max(x(t)) - \min(x(t))]\right),$$

an effective value $$\left(\sqrt{\frac{1}{N}\sum_{i=1}^{N}(x(i)-\bar{x})^2}\right),$$

a fluctuation ratio $$\left(\frac{\text{Peak}}{RMS}\right),$$

a pointed degree $$\left(\frac{\sum_{i=1}^{N}(x(i)-\bar{x})^3}{N(RMS)^3}\right),$$

skewness $$\left(\frac{\sum_{i=1}^{N}(x(i)-\bar{x})^4}{N(RMS)^4}\right),$$

a clearance factor $$\left(\frac{\text{Peak}}{\frac{1}{N}\left(\sum_{i=1}^{N}\sqrt{|x(i)|}\right)^2}\right),$$

an impulse factor $$\left(\frac{\text{Peak}}{\frac{1}{N}\sum_{i=1}^{N}|x(i)|}\right),$$

a shape factor $$\left(\frac{RMS}{\frac{1}{N}\sum_{i=1}^{N}|x(i)|}\right),$$

a probability function $$\left(P(x_i < x(t) \le x_i + \Delta x) = \sum_{i=1}^{N}\frac{\Delta t_i}{T} = \int P(x)dx = 1\right),$$

and statistical moment $$\left(P(x) = \frac{1}{B(b-a)^{\alpha+\beta-1}}(x-a)^{\alpha-1}(b-x)^{\beta-1},\ B \Rightarrow \int P(x)dx = 1\right)$$

of the indexes collected for a specific period).

The vehicle state distribution calculator 230 can calculate distribution about summary of vehicle states for a plurality of specific periods. The vehicle safety component diagnosis apparatus 130 can divide the entire period for vehicle safety component diagnosis into a plurality of specific periods, and the vehicle state distribution calculator 230 can arrange a plurality of specific periods in order to time and then can integrate distribution about summary of a vehicle state for the entire period.

In an embodiment, the vehicle state distribution calculator 230 can create multi-dimensional coordinate system composed of coordinate axes respectively corresponding to a plurality of diagnosis items and can calculate distribution about a plurality of index values for a plurality of specific periods in the multi-dimensional coordinate system. The vehicle state distribution calculator 230 can integrally show index values for diagnosis items for the entire period calculated by the vehicle state summarizer 210 in one coordinate system.

The multi-dimensional coordinate system may be implemented such that each axis corresponds to one diagnosis item, and the units of the axes may respectively correspond to the index unit for diagnosis pints of diagnosis items. For example, when there are a total of three diagnosis items of engine overheating, over gap of a ball joint, and a fixed quantity of refueling, a first axis of the multi-dimensional coordinate system may correspond to the engine overheating, a second axis may correspond to the over gap of a ball joint, and a third axis may correspond to the fixed amount of refueling. Further, when the index of engine temperature is divided into a total of ten levels, the first axis can use a unit divided into a total of ten levels.

In an embodiment, the vehicle state distribution calculator 230 can create multi-dimensional coordinate system composed of coordinate axes respectively corresponding to a plurality of sensor and can calculate distribution about a plurality of sensor values for a plurality of specific periods in the multi-dimensional coordinate system. In another embodiment, the vehicle state distribution calculator 230 can create a multi-dimensional coordinate system corresponding to a plurality of diagnosis items. Axes of a multi-dimensional coordinate system that correspond to one diagnosis item may correspond to sensors related to diagnosis parameters included in the diagnosis item. The vehicle safety component diagnosis apparatus 130 can store the multi-dimensional coordinate system created by the vehicle state distribution calculator 230 in a database 150 and can use the multi-dimensional coordinate system for safety component diagnosis.

The abnormal safety component detector 250 can detect an abnormal safety component by determining an abnormal situation related to a specific sensing value through distribution about summary of a vehicle state. For example, when a multi-dimensional coordinate system is composed of axes respectively corresponding to sensors and when there is a sensing value spaced a specific distance apart from sensing values distributed in a predetermined region through distribution about summary of a vehicle state, it is determined that there is an abnormal situation in the sensing value, thereby being able to determine that there is abnormality in a safety component related to the corresponding sensor.

In an embodiment, the abnormal safety component detector 250 can determine a first safety standard for coordinate axes on the basis of distribution about a plurality of index values in a multi-dimensional coordinate system and can determine a safety component related to a diagnosis item corresponding to a corresponding axis as an abnormal safety component when there is an index value out of the first safety standard.

The first safety standards for diagnosis items can be calculated as follows.

1) Engine overheating

*T*refer (engine RPM,vehicle speed,accelerator pedal angle,external air temperature)=Ref. Level of Index (engine RPM,vehicle speed,accelerator pedal angle,external air temperature)**Fte* (1.5, 2.0: warning,alarm) in index of engine temperature (engine RPM,vehicle speed,accelerator pedal angle external air temperature) at RPM*TL*<engine RPM<RPM*TH,VTL* (engine RPM)<vehicle speed<*VTH* (engine RPM), and *ATL* (engine RPM,vehicle speed)<accelerator pedal angle<*ATH* (engine RPM, vehicle speed) & CLASS (external air temperature)

2) Ball joint over gap

*Dv*ref (vehicle speed,deceleration)=Ref. Level of Index (vehicle speed,deceleration)**Fdv* (=1.5, 2.0: warning,alarm) at *VDL*<vehicle speed *VDH* and *DVL* (vehicle speed)<deceleration<*DVH* (vehicle speed)

*Pc*ref (vehicle speed,acceleration)=Ref. Level of Index (speed,acceleration)**Fpc* (=1.5,2.0: warning,alarm) at *VPL*<vehicle speed *VPH* and *AVL* (vehicle speed)<acceleration<*AVH* (vehicle speed)

3) Fixed amount of refueling

*Q*ref (initial amount of fuel,GPS)=*Q*peak (initial amount of fuel,GPS)**Fq* (=1.05,1.10: warning, alarm) in amount of refueling (initial amount of fuel, GPS) at *QTL*<initial amount of fuel<*QTH* and GPS 4) Sudden start

*A*ref (vehicle speed,accelerator pedal angle,engine RPM)=*A*peak (vehicle speed,accelerator pedal angle,engine RPM)**Fa* (=1.05,1.10: warning, alarm) at RPM*FL*<engine RPM<RPM*FH,VAL* (engine RPM)<speed<*VAH* (engine RPM), and *ATL* (engine RPM, vehicle speed)<accelerator pedal angle<*ATH* (engine RPM,vehicle speed)

5) Driving shaft

*Ds*ref (vehicle speed,steering angle)=Ref. Level of Index (vehicle speed,steering angle)**Fds* (=1.5, 2.0: warning,alarm) in Index of *BPF* knuckle vibration (vehicle speed,steering angle) at *VNL*<vehicle speed<*VNH*, and *STL* (vehicle speed)<steering angle<*STH* (vehicle speed)

6) Wheel bearing

*Wb*ref (vehicle speed,accelerator pedal angle)=Ref. Level of Index (vehicle speed,accelerator pedal angle)**Fwb* (=1.5,2.0: warning,alarm) in Index of *BPF* knuckle vibration (vehicle speed,accelerator pedal angle) at *VNL*<vehicle speed<*VNH*, and *ATL* (vehicle speed)<accelerator pedal angle<*ATH* (vehicle speed)

7) Wheel unbalance

*Wu*ref (vehicle speed,accelerator pedal angle)=Ref. Level of Index (vehicle speed,accelerator pedal angle)**Fwu* (=1.5,2.0: warning,alarm) in Index of *LPF* knuckle vibration (vehicle speed,accelerator pedal angle) at *VNL*<vehicle speed<*VNH*, and *ATL* (vehicle speed)<accelerator pedal angle<*ATH* (vehicle speed)

8) Brake judder

*Jd*ref (vehicle speed,deceleration)=Ref. Level of Index (vehicle speed,accelerator pedal angle) **Fjd* (=1.5,2.0: warning,alarm) in Index of *LPF* knuckle vibration (vehicle speed,deceleration) at *VNL*<vehicle speed<*VNH*, and *DTL* (vehicle speed)<deceleration<*DTH* (vehicle speed)

9) Damper

*Dp*ref (steering angle,vehicle speed,deceleration)=Ref. Level of Index (steering angle,vehicle speed,deceleration)**Fdp* (=1.2,1.5: warning, alarm) in Index of *LPF* damping vibration [car body vibration–knuckle vibration] (steering angle,vehicle speed,deceleration) at *STRL*<steering angle<*STRH, VLL* (steering angle)<vehicle speed<*VLH* (steering angle), and *ADL* (steering angle, vehicle speed) <deceleration<*ADH* (steering angle, vehicle speed)

10) Timing belt

*T*refer (engine RPM,vehicle speed,accelerator pedal angle)=Ref. Level of Index (engine RPM,vehicle speed,accelerator pedal angle)**Ftb* (1.2, 1.5: warning,alarm) in index of *BPF* engine vibration (engine RPM, vehicle speed, accelerator pedal angle) at RPM*NL*<engine RPM<RPM*NH, VNL* (engine RPM)<vehicle speed<*VNH* (engine RPM), and *ATL* (engine RPM, vehicle speed)<accelerator pedal angle<*ATH* (engine RPM, vehicle speed)

11) Wheel alignment

*Swa*ref–*wadfi* (vehicle speed)=Ref. Level of Index (vehicle speed)**Fwa* (=1.2,1.5: warning,alarm) in Index of *LPF* transverse vibration of wheel *FFT* Spectrum (vehicle speed) on wheel alignment defect frequency (*wadfi*) at *VNL*<vehicle speed<*VNH*

In an embodiment, when an index value related to a corresponding coordinate axis and being out of the first safety standard exists for a specific number of specific continuous periods, the abnormal safety component detector 250 can determine a safety component related to the diagnosis item corresponding to the coordinate axis as an abnormal safety component. The predetermined number 'n' (n is a natural number) may be set in advance or automatically in the vehicle safety component diagnosis apparatus 130.

Diagnosis algorithms respectively for diagnosis items may be defined as follows.

1) Engine overheating

Index of engine temperature (engine RPM,vehicle speed,accelerator pedal angle,external air temperature)>*Te*ref (engine RPM,vehicle speed, accelerator pedal angle,external air temperature) & Repeat (*n*) at RPM*T*0<engine RPM<RPM*T*1, *VT*0 (engine RPM)<vehicle speed<*VT*1 (engine RPM), and *AT*0 (engine RPM, vehicle speed) <accelerator pedal angle<*AT*1 (engine RPM, vehicle speed) & CLASS (external air temperature)

2) Ball joint over gap

Index of dive_joint relative displacement (vehicle speed,deceleration)>*Dv*ref (vehicle speed,deceleration) & Repeat (*n*) at *VT*0<vehicle speed<*VT*1 and *DVT*0 (vehicle speed) <deceleration<*DVT*1 (vehicle speed)

Index of pitch_joint relative displacement (vehicle speed,acceleration)>*Pc*ref (vehicle speed,acceleration) & Repeat (*n*) at *VT*0<vehicle speed<*VT*1 and *AVT*0 (vehicle speed) <acceleration<*AVT*1 (vehicle speed)

3) Fixed amount of refueling

Difference of refueling amount [amount of refueling–flow rate by flowmeter] (initial amount of fuel,GPS)<*Q*ref (initial amount of fuel,GPS) at *QT*0<initial amount of fuel<*QT*1 and GPS 4) Sudden start acceleration=differential [vehicle speed] (vehicle speed,accelerator pedal angle,engine RPM)>limited acceleration ac (vehicle speed,accelerator pedal angle,engine RPM) at RPM*F*0<engine RPM<RPM*F*1, *VT*0 (engine RPM)<speed<*VT*1 (engine RPM), and *AT*0 (engine RPM, vehicle speed)<accelerator pedal angle<*AT*1 (engine RPM, vehicle speed)

5) Driving shaft

Index of *BPF* knuckle vibration (vehicle speed,steering angle)>*Ds*ref (vehicle speed,steering angle) & Repeat (*n*) at *VNL*<vehicle speed<*VNH*, and *STL* (vehicle speed)<steering angle<*STH* (vehicle speed)

6) Wheel bearing

Index of *BPF* knuckle vibration (vehicle speed,accelerator pedal angle)>*Wb*ref (vehicle speed,accelerator pedal angle) & Repeat (*n*) at *VNL*<vehicle speed<*VNH*, and *ATL* (vehicle speed)<accelerator pedal angle<*ATH* (vehicle speed)

7) Wheel unbalance

Index of *LPF* knuckle vibration (vehicle speed,accelerator pedal angle)>Wuref (vehicle speed,accelerator pedal angle) & Repeat (*n*) at *VNL*<vehicle speed<*VNH*, and *ATL* (vehicle speed)<accelerator pedal angle<*ATH* (vehicle speed)

8) Brake judder

Index of *LPF* knuckle vibration (vehicle speed,deceleration)>*Jd*ref (vehicle speed,deceleration) & Repeat (*n*) at *VNL*<vehicle speed<*VNH*, and *ATL* (vehicle speed)<deceleration<*ATH* (vehicle speed)

9) Damper

Index of *LPF* damping vibration=[car body vibration−knuckle vibration] (steering angle,vehicle speed,deceleration)>*Dp*ref (steering angle,vehicle speed,deceleration) & Repeat (*n*) at *STRL*<steering angle<*STRH, VLL* (steering angle)<vehicle speed<*VLH* (steering angle), and *ADL* (steering angle, vehicle speed) <deceleration<*ADH* (steering angle, vehicle speed)

10) Timing belt

Index of *BPF* engine vibration (engine RPM,vehicle speed,accelerator pedal angle)>*Tb*ref (engine RPM,vehicle speed,accelerator pedal angle) & Repeat (*n*) at RPM*NL*<engine RPM<RPM*NH, VNL* (engine RPM)<vehicle speed<*VNH* (engine RPM), and *ATL* (engine RPM,vehicle speed)<accelerator pedal angle<*ATH* (engine RPM, vehicle speed)

11) Wheel alignment

Index of *LPF* transverse vibration of wheel (vehicle speed)>*Wa*ref (vehicle speed) & Repeat (*n*) at *VNL*<vehicle speed<*VNH*

The precise diagnosis performer 270 can perform precise diagnosis on an abnormal safety component. In more detail, as for the engine overheating, ball joint over gap, wheel alignment, sudden start, and a fixed quantitative of refueling of the diagnosis items, the precise diagnosis performer 270 can immediately determine that there is a defect in safety components related to corresponding diagnosis items through comparison with the first safety standards. Further, as for the driving wheel, wheel bearing, wheel alignment, brake judder, damper, timing belt, and wheel alignment of the diagnosis items, the precise diagnosis performer 270 can perform additional diagnosis on the abnormal safety component determined through comparison with the first safety standards.

In an embodiment, the precise diagnosis performer 270 can calculate precise diagnosis indexes through any one of envelope analysis and Fast Fourier Transform (FFT) on the basis of sensing values collected for a specific period for sensors related to abnormal safety components. The vehicle safety component diagnosis apparatus 130 can set in advance which one of envelope analysis and FFT it will use in accordance with the types of diagnosis items. Envelope analysis or FFT is well known to those skilled in the art, so they are not described in detail.

For example, when a diagnosis related to an abnormal safety component is a driving shaft, the precise diagnosis performer 270 can calculate an enveloping spectrum through envelope analysis for sensing values of diagnosis parameters related to knuckle vibration that is the diagnosis pint of the driving shaft. The precise diagnosis performer 270 can perform precise diagnosis using the enveloping spectrum as a precise diagnosis index for the 'driving shaft'.

In an embodiment, the precise diagnosis performer 270 can sample and use sensing values collected for a specific period to calculate a precise diagnosis index. Further, the precise diagnosis performer 270 can perform sampling with a cycle shorter than the cycle in which the vehicle state summarizer 210 samples sensing values to summarize a vehicle state.

In an embodiment, the precise diagnosis performer 270 can determine second safety standards on the basis of precise diagnosis indexes for a plurality of specific periods, and can diagnose defects of abnormal safety components by comparing the second safety standards and the precise diagnosis indexes. In more detail, the precise diagnosis performer 270 can determine that there is a defect in a safety component when there is a precise diagnosis index exceeding the second safety standards.

The second safety standards for diagnosis items can be calculated as follows.

1) Driving shaft

*Sd*vref-*dsdfi* (vehicle speed,steering angle)=Ref. Level of Index (vehicle speed,steering angle) **Fds* (=1.5,2.0: warning,alarm) in Index of *BPF* knuckle vibration Enveloping Spectrum (vehicle speed,steering angle) on driving defect frequency (*dsdfi*), at *VNL*<vehicle speed<*VNH*, and *STL* (vehicle speed)<steering angle<*STH* (vehicle speed)

2) Wheel bearing

*Swb*ref-*wbdfi* (vehicle speed,accelerator pedal angle)=Ref. Level of Index (vehicle speed,accelerator pedal angle)**Fwb* (=1.5,2.0: warning, alarm) in Index of *BPF* knuckle vibration Enveloping Spectrum (vehicle speed,accelerator pedal angle) on wheel bearing defect frequency (*wdfi*) at *VNL*<vehicle speed<*VNH*, and *ATL* (vehicle speed)<accelerator pedal angle<*ATH* (vehicle speed)

3) Wheel unbalance

*Swu*ref-*wudfi* (vehicle speed,accelerator pedal angle)=Ref. Level of Index (vehicle speed,accelerator pedal angle)**Fwn* (=1.5,2.0: warning, alarm) in Index of *LPF* knuckle vibration *FFT* Spectrum (vehicle speed,accelerator pedal angle) on wheel balance defect frequency (*wudfi*) at *VNL*<vehicle speed<*VNH*, and *ATL* (vehicle speed)<accelerator pedal angle<*ATH* (vehicle speed)

4) Brake judder

*Sjd*ref-*jddfi* (vehicle speed,deceleration)=Ref. Level of Index (vehicle speed,deceleration)**Fjd* (=1.5, 2.0: warning,alarm) in Index of *LPF* knuckle vibration *FFT* Spectrum (vehicle speed,deceleration) on brake judder defect frequency (*jddfi*) at *VNL*<vehicle speed<*VNH*, and *DTL* (vehicle speed)<deceleration<*DTH* (vehicle speed)

5) Damper

*Sdp*ref-*dpdfi* (steering angle,vehicle speed,deceleration)=Ref. Level of Index (steering angle,vehicle speed,deceleration)**Fdp* (=1.2,1.5: warning,alarm) in Index of *LPF* damping vibration [car body vibration−knuckle vibration] *FFT* Spectrum (steering angle,vehicle speed,deceleration) on damper defect frequency (*dpdfi*) at *STRL*<steering angle<*STRH, VLL* (steering angle)<vehicle speed<*VLH* (steering angle), and *ADL* (steering angle, vehicle speed) <deceleration<*ADH* (steering angle, vehicle speed)

6) Timing belt

*Stb*ref-*tbdfi* (engine RPM,vehicle speed,accelerator pedal angle)=Ref. Level of Index (engine RPM, vehicle speed,accelerator pedal angle)**Ftb* (1.2, 1.5: warning,alarm) in Index of *BPF* engine vibration *FFT* Spectrum (engine RPM,vehicle speed,accelerator pedal angle) on timing belt defect frequency (*tbdfi*) at RPM*NL*<engine RPM<RPM*NH, VNL* (engine RPM)<vehicle speed<*VNH* (engine RPM), and *ATL* (engine RPM, vehicle speed)<accelerator pedal angle<*ATH* (engine RPM, vehicle speed)<accelerator pedal angle<*ATH* (engine RPM, vehicle speed)

7) Wheel alignment

*Swa*ref-*wadfi* (vehicle speed)=Ref Level of Index (vehicle speed)**Fwa* (=1.2,1.5: warning,alarm) in Index of *LPF* transverse vibration of wheel *FFT* Spectrum (vehicle speed) on wheel alignment defect frequency (*wadfi*) at *VNL*<vehicle speed<*VNH*

In an embodiment, when a precise diagnosis index repeatedly exceeds the second safety standards for a specific number of continuous specific periods, the precise diagnosis performer 270 can determine that there is a defect in an abnormal safety component. The predetermined number 'n' (n is a natural number) may be set in advance or automatically in the vehicle safety component diagnosis apparatus 130.

Diagnosis algorithms respectively for diagnosis items may be defined as follows.

1) Driving shaft

Index of *BPF* knuckle vibration Enveloping Spectrum (vehicle speed,steering angle)>*Sds*ref-*dsdfi* (vehicle speed,steering angle) & Repeat (*n*) on driving shaft defect frequency (*dsdfi*) at *VNL*<vehicle speed<*VNH*, and *STL* (vehicle speed)<steering angle<*STH* (vehicle speed)

2) Wheel bearing

Index of *BPF* knuckle vibration Enveloping Spectrum (vehicle speed,accelerator pedal angle)>*Swb*ref-*wbdfi* (vehicle speed,accelerator pedal angle) & Repeat (*n*) on wheel bearing defect frequency (*wbdfi*) at *VNL*<vehicle speed<*VNH*, and *ATL* (vehicle speed)<accelerator pedal angle<*ATH* (vehicle speed)

3) Wheel unbalance

Index of *LPF* knuckle vibration *FFT* Spectrum (vehicle speed,accelerator pedal angle)>*Swu*ref-*wudfi* (vehicle speed,accelerator pedal angle) & Repeat (*n*) on wheel unbalance defect frequency (*wudfi*) at *VNL*<vehicle speed<*VNH*, and *ATL* (vehicle speed)<accelerator pedal angle<*ATH* (vehicle speed)

4) Brake judder

Index of *LPF* knuckle vibration *FFT* Spectrum (vehicle speed,deceleration)>*Sjd*ref-*jddfi* (vehicle speed,deceleration) & Repeat (*n*) on brake judder defect frequency (*jddfi*) at *VNL*<vehicle speed<*VNH*, and *ATL* (vehicle speed) <deceleration<*ATH* (vehicle speed)

5) Damper

Index of *LPF* damping vibration damping coefficient of *FFT* Spectrum=[car body vibration−knuckle vibration] (steering angle,vehicle speed,deceleration)>*Sdp*ref-*dpdfi* (steering angle,vehicle speed,deceleration) & Repeat (*n*) on damper defect frequency (*dpdfi*) at *STRL*<steering angle<*STRH, VLL* (steering angle)<vehicle speed<*VLH* (steering angle), and *ADL* (steering angle, vehicle speed)<deceleration<*ADH* (steering angle, vehicle speed)

6) Timing belt

Index of *BPF* engine vibration *FFT* Spectrum (engine RPM,vehicle speed,accelerator pedal angle)>*Stb*ref-*tbdfi* (engine RPM,vehicle speed, accelerator pedal angle) & Repeat (*n*) on timing belt defect frequency (*tbdfi*) at RPMNL<engine RPM<RPM*NH, VNL* (engine RPM)<vehicle speed<*VNH* (engine RPM), and *ATL* (engine RPM, vehicle speed)<accelerator pedal angle<*ATH* (engine RPM, vehicle speed)<accelerator pedal angle<*ATH* (engine RPM, vehicle speed)

7) Wheel alignment

Index of *LPF* transverse vibration of wheel *FFT* Spectrum (vehicle speed)>Swaref (vehicle speed) & Repeat (*n*) on wheel alignment defect frequency (*wadfi*) at *VNL*<vehicle speed<*VNH*

The controller 290 can control the entire operation of the vehicle safety component diagnosis apparatus 130 and can manage control flow or data flow among the vehicle state summarizer 210, the vehicle state distribution calculator 230, the abnormal safety component detector 250, and the precise diagnosis performer 270.

Figure 3:
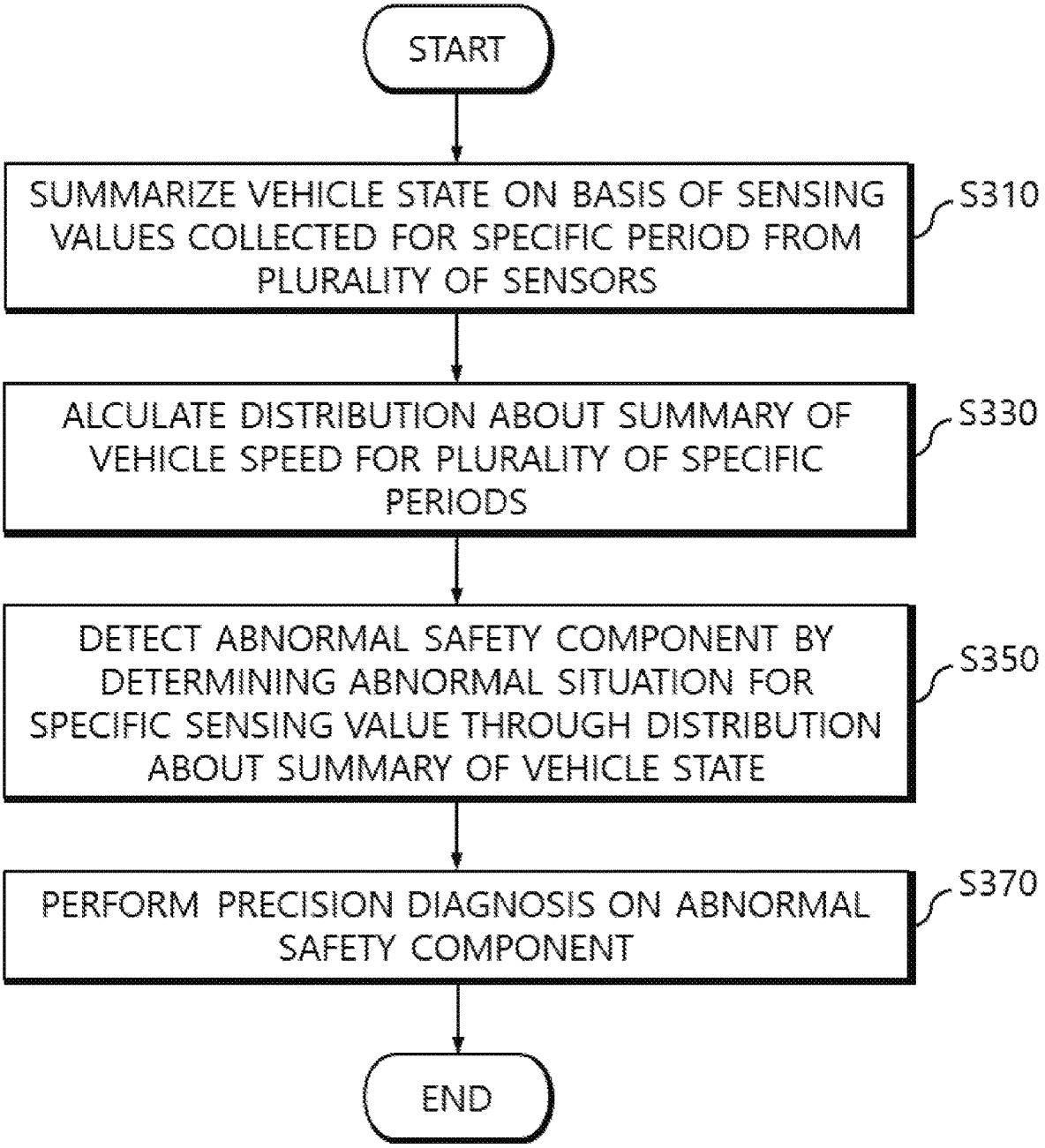
FIG. 3 is a flowchart illustrating a vehicle safety component diagnosis process that is performed in the vehicle safety component diagnosis apparatus shown in FIG. 1.

FIG. 3 is a flowchart illustrating a vehicle safety component diagnosis process that is performed in the vehicle safety component diagnosis apparatus shown in FIG. 1.

Referring to FIG. 3, the vehicle safety component diagnosis apparatus 130 can summarize a vehicle state on the basis of sensing values collected for a specific period from a plurality of sensors through the vehicle state summarizer 210 (step S310). The vehicle safety component diagnosis apparatus can 130 calculate distribution about summary of a vehicle speed for a plurality of specific periods through the vehicle state distribution calculator 230 (step S330).

The vehicle safety component diagnosis apparatus 130 can detect an abnormal safety component by determining an abnormal situation for a specific sensing value through distribution about summary of a vehicle state through the abnormal safety component detector 250 (step S350). The vehicle safety component diagnosis apparatus 130 can perform precision diagnosis on abnormal safety components through the precise diagnosis performer 270 (step S370).

FIGS. 4 to 7 are exemplary views illustrating a process of determining an index for a diagnosis point using an index for a diagnosis parameter in the vehicle safety component diagnosis apparatus shown in FIG. 1.

Referring to FIGS. 4 to 7, it can be seen the process in which the vehicle safety component diagnosis apparatus 130 calculates an index for a diagnosis point a included in a diagnosis items A using diagnosis parameters. In more detail, the diagnosis pint a may include a speed, power, a railroad, and temperature as diagnosis parameters, in which the speed and power each may be configured in ten steps (or levels), and the railroad and temperature each may be configured in five levels.

Figure 7:
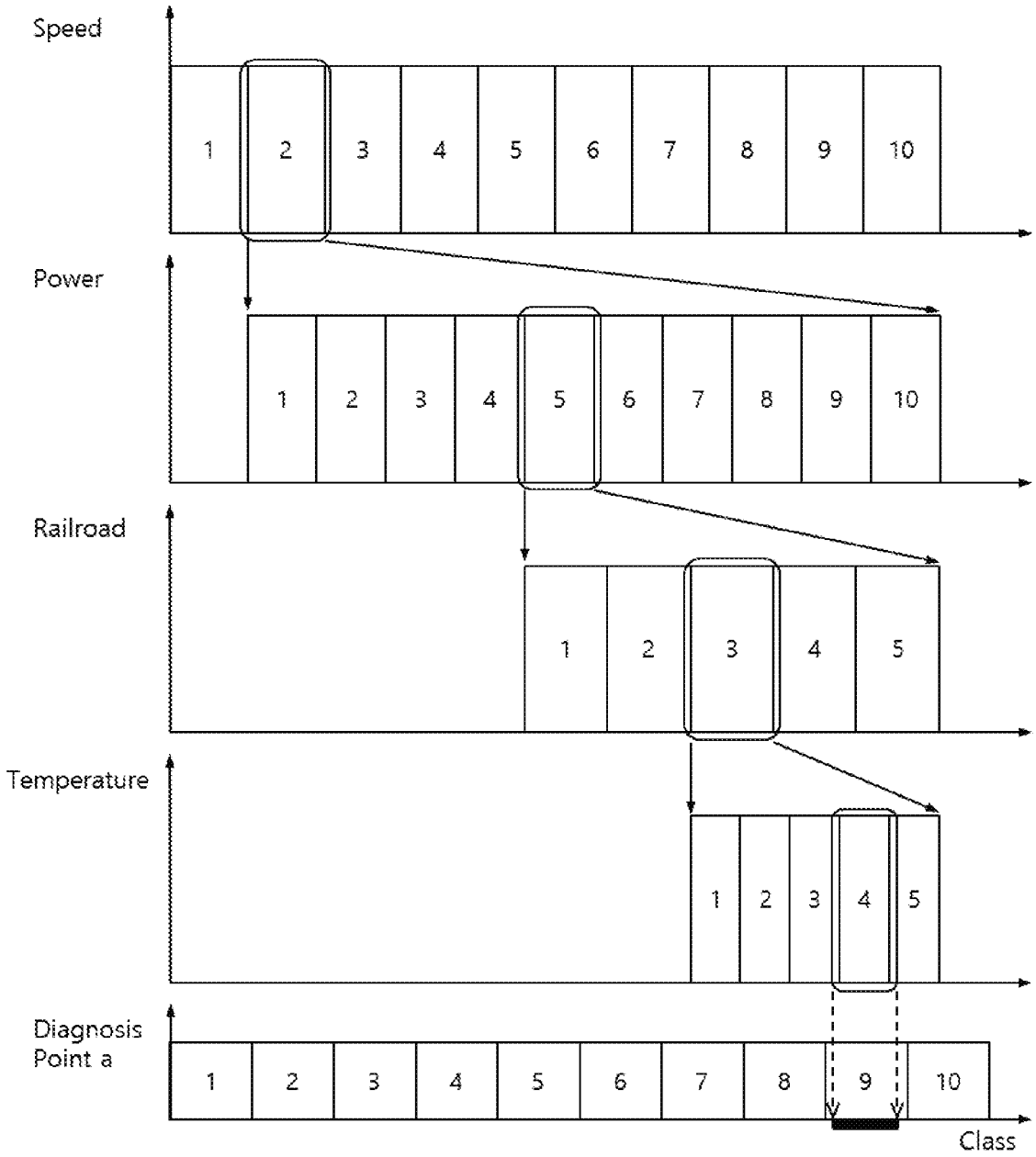

For example, when speed=2, power=5, railroad=3, and temperature=4 for the diagnosis point a, it is possible to divide the period from step of speed 2 to step of speed 10 into ten steps of power in FIG. 4, the period from step of power 5 to step of power 10 into five steps of railroad in FIG. 5, and the period from step of railroad 3 to step of railroad 5 into five steps of temperature in FIG. 6. In FIG. 7, the vehicle safety component diagnosis apparatus 130 can finally determine the step 9 of the diagnosis point a including the period corresponding to the step of temperature 4 as the index of a.

Figure 8:
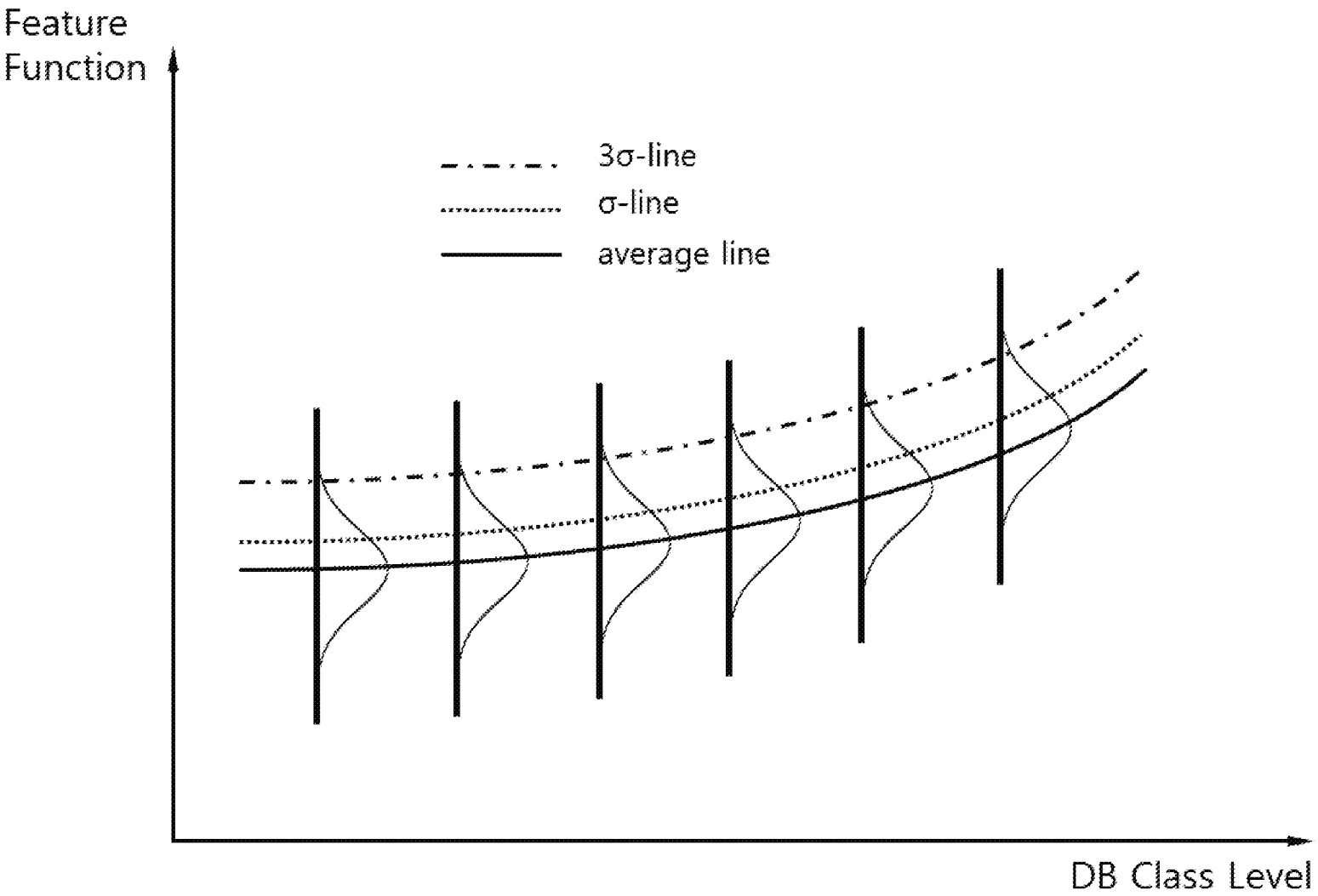
FIG. 8 is an exemplary view illustrating a process of calculating index distribution for a diagnosis points in the vehicle safety component diagnosis apparatus shown in FIG. 1.

FIG. 8 is an exemplary view illustrating a process of calculating index distribution for a diagnosis points in the vehicle safety component diagnosis apparatus shown in FIG. 1.

Referring to FIG. 8, the vehicle safety component diagnosis apparatus 130 can show the index distribution for the diagnosis point a in a graph. The vehicle safety component diagnosis apparatus 130 can create a 2-dimensional graph by setting a characteristic function corresponding to the diagnosis point a on the y-axis and a DB Class corresponding to the index of the diagnosis point a on the x-axis.

In FIG. 8, the diagnosis pint a may include a speed, power, a railroad, and temperature as diagnosis parameters, in which the speed and power each may be configured in ten steps (or levels), and the railroad and temperature each may be configured in five levels. The vehicle safety component diagnosis apparatus 130 can calculate the total steps (or levels) of the DB Class corresponding to the x-axis through product of the number of steps of the diagnosis parameters. For example, the total step of DB Class for the diagnosis point a may be expressed as speed*power*railroad*temperature=10*10*5*5=2500.

The vehicle safety component diagnosis apparatus 130 can determine the index for the diagnosis point a using the index of the diagnosis parameter, and can determine an average line, a σ-line (a is a standard deviation), a 3σ-line, etc. about a characteristic function at all the levels on the basis of the calculated index under the assumption that corresponding characteristic functions follow Gaussian Distribution at the respective levels. The vehicle safety component diagnosis apparatus 130 can determine the index for the diagnosis parameter using sensor values obtained from a plurality of sensors for respective diagnosis points and can create and store DB Class classification information about the diagnosis point shown in FIG. 8 in the database 150 using the determined diagnosis parameter. The vehicle safety component diagnosis apparatus 130 can determine an abnormal situation about a corresponding diagnosis pint on the basis of the DB Class classification information for respective diagnosis points created through the process described above, and can perform diagnosis on vehicle safety components.

Figure 9:
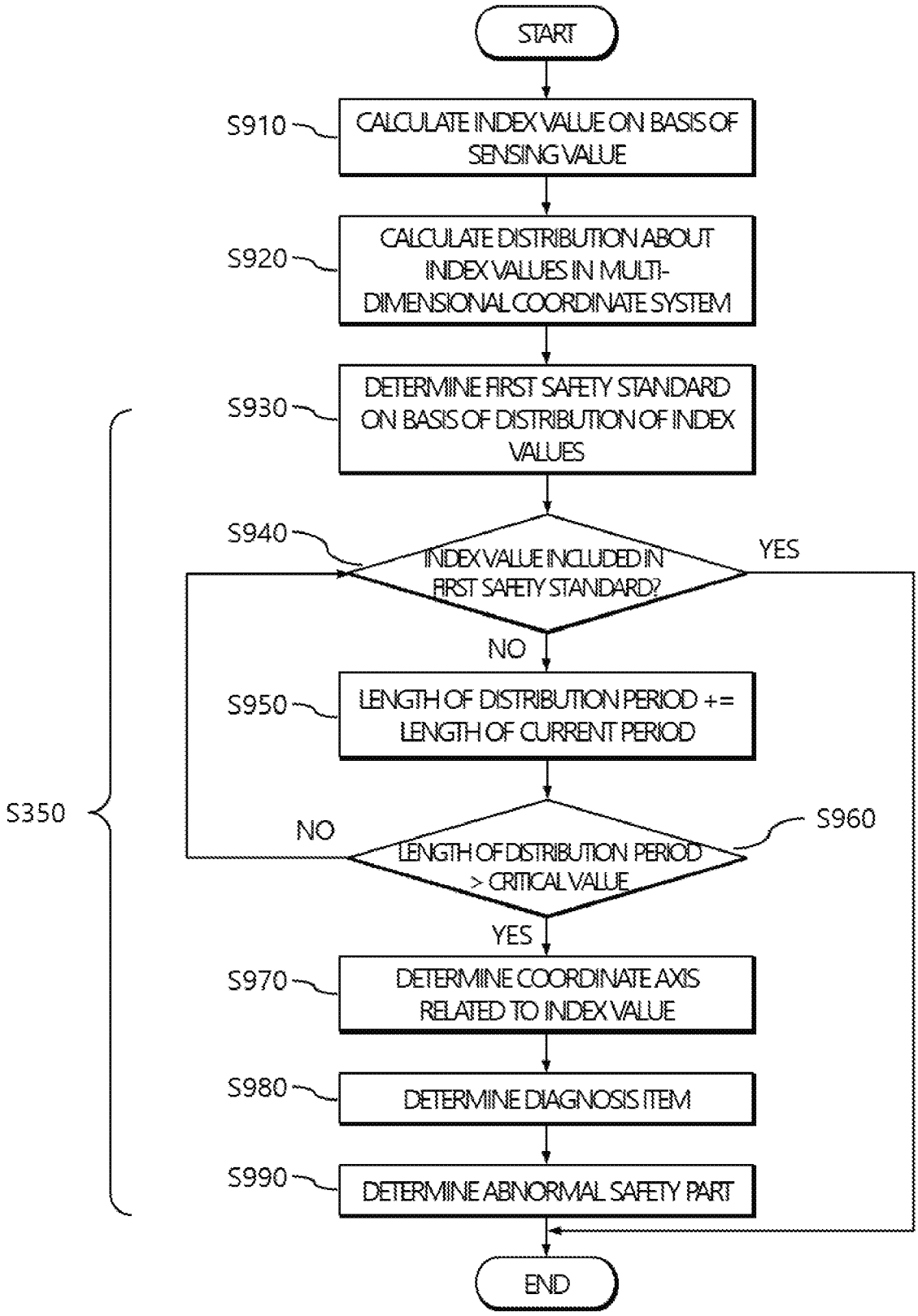
FIG. 9 is a flowchart illustrating an embodiment of step S350 of FIG. 3.

FIG. 9 is a flowchart illustrating an embodiment of step S350 of FIG. 3.

Referring to FIG. 9, the vehicle safety component diagnosis apparatus 130 can summarize a vehicle state by calculating index value for a plurality of diagnosis items constituting the vehicle state using sensing values collected for a specific period through the vehicle state summarizer 210 (step S910). The vehicle safety component diagnosis apparatus 130 can calculate distribution about summary of a vehicle speed for a plurality of specific periods through the vehicle state distribution calculator 230 (step S920).

Further, the abnormal safety component detector 250 of the vehicle safety component diagnosis apparatus 130 can detect an abnormal safety component by determining an abnormal situation for a specific sensing value through distribution about summary of a vehicle state in a multi-dimensional coordinate system (step S350).

In more detail, the abnormal safety component detector 250 can determine first safety standards for coordinate axes on the basis of distribution about a plurality of index values in a multi-dimensional coordinate system (step S930). The abnormal safety component detector 250 can store the first safety standards in the database 150.

The abnormal safety component detector 250 can detect whether an index value related to a vehicle state, which is calculated in real time on the basis of information collected from the vehicle 110, comes out of the first safety standards (step S940). In this case, the index value can be created at every specific cycle and can be used as a representative value for the cycle.

The abnormal safety component detector 250 can calculate the total length of a distribution period in which abnormality has been detected, by adding the length of the current period to the length of a previous distribution period when an index value comes out of the first safety standards (step S950). The abnormal safety component detector 250 can detect whether the total length of a distribution period exceeds a predetermined critical value (step S960). When the length of the distribution period is the critical value or less, it is possible to repeatedly perform the abnormality detection step for an index value for the next period.

If the total length of a distribution exceeds the critical value, which means the case in which abnormality of an index value continuously occurs and there is a high possibility of generation of a defect, so the abnormal safety component detector 250 can determine a coordinate axis related to the index value in a multi-dimensional coordinate system (step S970). On the other hand, when an index value is temporarily rapidly changed due to influence by disturbance, the abnormal safety component detector 250 sets a critical value to minimize influence on a diagnosis result, thereby being able to determine abnormality of a safety component only when the total length of a distribution period out of the first safety standards exceeds the critical value. The critical value in this case can be set for each diagnosis item in consideration of the degree of influence on the index value by the disturbance.

The coordinate systems constituting a multi-joint coordinate system are defined to correspond to diagnosis items, respectively, so the abnormal safety component detector 250 can determine diagnosis items respectively corresponding the coordinate axes (step S980) and can determine the safety components corresponding to the diagnosis items as abnormal safety components (step S990).

Figure 10:
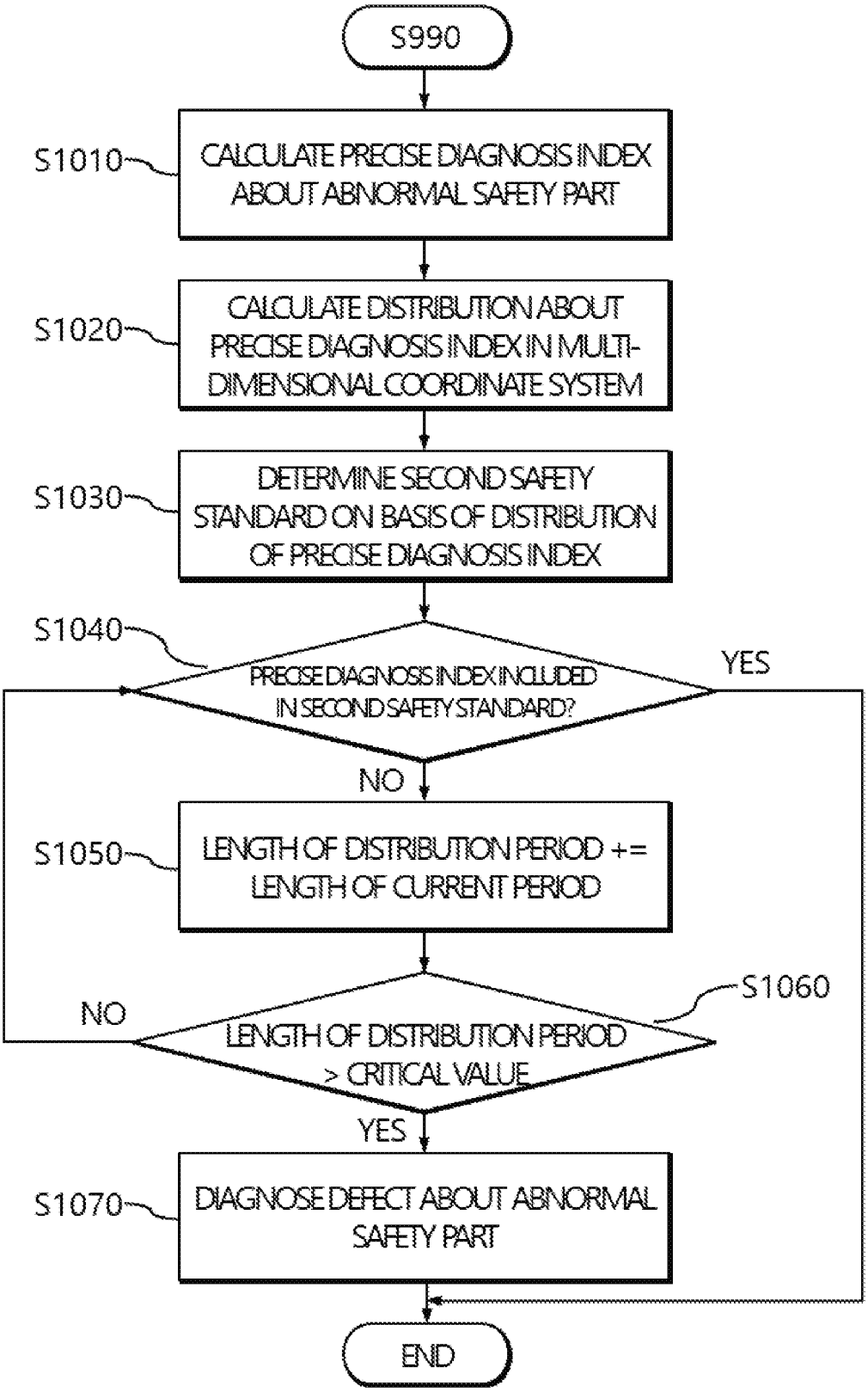
FIG. 10 is a flowchart showing an embodiment of step S370 of FIG. 3.

FIG. 10 is a flowchart showing an embodiment of step S370 of FIG. 3.

Referring to FIG. 10, when an abnormal safety component is detected by the abnormal safety component detector 250, the vehicle safety component diagnosis apparatus 130 can perform precise diagnosis on the abnormal safety component through the precise diagnosis performer 270.

In more detail, when an abnormal safety component is determined in step S990, the precise diagnosis performer 270 can calculate a precise diagnosis index related to the abnormal safety component (step S1010).

The precise diagnosis performer 270 can calculate distribution about the precise diagnosis index in a multi-dimensional coordinate system (step S1020) and can determine second safety standards on the basis of distribution of the precise diagnosis index (step S1030). The precise diagnosis performer 270 can store the second safety standards in the database 150.

On the other hand, the first safety standards and the second safety standards can be compared, as follows. First, the first safety standards are related to index values calculated on the basis of values in a time domain, but the second safety standards may be related to precise diagnosis indexes calculated on the basis of values in a frequency domain. Second, the index values that are compared with the first safety standards are calculated at every first cycle, but the precise diagnosis indexes that are compared with the second safety standards may be calculated at every second cycle longer than the first cycle. Third, the first sampling cycle of sensing values that are used to calculate index values may be set with a cycle longer than the second sampling cycle of sensing values that are used to calculate precise diagnosis indexes. That is, index values are calculated as sensing values sampled at a high frequency, but precise diagnosis indexes may be calculated as sensing values sampled at a high frequency.

The precise diagnosis performer 270 can detect whether a precise diagnosis index, which is calculated in real time on the basis of information collected from the user vehicle 110, comes out of the second safety standards (step S1040). In this case, the precise diagnosis index can be created at every specific cycle and can be used as a representative value for the cycle.

The precise diagnosis performer 270 can calculate the total length of a distribution period in which abnormality has been detected, by adding the length of the current period to the length of a previous distribution period when the precise diagnosis index comes out of the first safety standards (step S1050). The precise diagnosis performer 270 can detect whether the total length of a distribution period exceeds a predetermined critical value (step S1060). When the length of the distribution period is the critical value or les, it is possible to repeatedly perform the abnormality detection step for a precise diagnosis index for the next period.

If the total length of the distribution period exceeds the critical value, which is a case in which abnormality of a precise diagnosis index is continuously generated and which means that there is a high possibility of generation of a defect, so the precise diagnosis performer 270 can diagnosis a defect about the corresponding abnormal safety component (step S1070).

Meanwhile, the vehicle safety component diagnosis apparatus 130 can delete all the index values and the data used to calculate precise diagnosis indexes in the first and second periods set in advance in order to reduce the amount of data that is stored in memories or transmitted through communication. Accordingly, only representative values showing the characteristics (e.g., the index values and precise diagnosis indexes in each period) remain in the data before the first and second periods, and the representative values can be transmitted through communication.

Further, the precise diagnosis indexes with a lot of data to be stored/transmitted and the second safety standards are calculated with a very long cycle in comparison to the first safety standards, so the amount of data to be stored/transmitted can be reduced.

Further, when abnormality is found out in related diagnosis items on the basis of index values and the first safety standards, precise diagnosis indexes and the second safety standards are calculated regardless of the first safety standards, so it is possible to improve accuracy in diagnosis and reduce consumption of memory resources for calculating the precise diagnosis index and the second safety standards.

Further, only representative values that can show the tendency of data are stored rather than storing/transmitting all data for diagnosis items, whereby it is possible to reduce the amount of data stored in memories or reduce the amount of data that are transmitted through communication.

Although the present disclosure was described above with reference to exemplary embodiments, it should be understood that the present disclosure may be changed and modified in various ways by those skilled in the art, without departing from the spirit and scope of the present disclosure described in claims.

The present disclosure can have the following effects. However, a specific embodiment is not intended to have to include all of the following effects or only the following effects, so the scope of a right of the present disclosure should not be construed as being limited by the embodiment.

The vehicle safety component diagnosis apparatus according to an embodiment of the present disclosure can determine abnormality of a safety component through distribution of an index value for a plurality of diagnosis items constituting a vehicle state.

The vehicle safety component diagnosis apparatus according to an embodiment of the present disclosure can precisely diagnose a defect of a safety component through comparison and analysis in a frequency domain by sampling sensing values collected for the entire period.

What is claimed is:

1. A vehicle safety component diagnosis apparatus, included in a vehicle and implemented to operate limitedly according to an on/off state of a brake pedal and an accelerator pedal for diagnostic items including an engine, a ball joint, a drive shaft, a wheel bearing, a brake judder, a damper, and a timing belt, comprising:

a vehicle state summarizer summarizing a vehicle state based on sensing values collected from a plurality of sensors included in the vehicle for a specific period;

a vehicle state distribution calculator calculating distribution of sensed values corresponding to vehicle states for a plurality of specific periods;

an abnormal safety component detector detecting an abnormal safety component by determining an abnormal situation about a specific sensing value through the calculated distribution of the sensed values corresponding to the vehicle states, the abnormal safety component being the drive shaft included in the vehicle; and a diagnosis performer performing diagnosis about the abnormal safety component and calculating an enveloping spectrum through envelope analysis for the sensing values of diagnosis parameters related to a knuckle vibration that is a diagnosis part of the driving shaft, wherein distribution safety standards are determined based on distribution about index values and the index values are calculated based on the sensing values in a time domain at every first cycle, diagnosis index safety standards are determined based on distribution of diagnosis indexes and the diagnosis indexes are calculated based on the sensing values in a frequency domain at every second cycle longer than the first cycle, a first sampling cycle of the sensing values for calculating the index values is longer than a second sampling cycle of the sensing values for calculating the diagnosis indexes, and the diagnosis indexes are stored in a memory and the index values and sensing values are deleted from memory to reduce an amount of data stored in the memory.

2. The vehicle safety component diagnosis apparatus of claim 1, wherein the vehicle state summarizer summarizes the vehicle state by calculating index values respectively for a plurality of diagnosis items constituting the vehicle state using the sensing values collected from the specific period.

3. The vehicle safety component diagnosis apparatus of claim 2, wherein the vehicle state distribution calculator creates a multi-dimensional coordinate system composed of coordinate axes respectively corresponding to the plurality of diagnosis items, and calculates distribution about a plurality of index values for the plurality of specific periods in the multi-dimensional coordinate system.

4. The vehicle safety component diagnosis apparatus of claim 3, wherein the abnormal safety component detector determines the distribution safety standards for respective coordinate axes based on the distribution about the plurality of index values in the multi-dimensional coordinate system, and determines a safety component related to a diagnosis item corresponding to a corresponding coordinate axis as the abnormal safety component when there is an index value being out of the distribution safety standards.

5. The vehicle safety component diagnosis apparatus of claim 4, wherein when a specific number of index values related to the corresponding coordinate axis and being out of the distribution safety standards are distributed in specific continuous periods, the abnormal safety component detector determines a safety component related to a diagnosis item corresponding to the corresponding coordinate axis as an abnormal safety component.

6. The vehicle safety component diagnosis apparatus of claim 1, wherein the diagnosis performer calculates a diagnosis index through at least one of envelope analysis and FFT (Fast Fourier Transform) based on the sensing values collected for the specific period for each of sensors related to the abnormal safety component.

7. The vehicle safety component diagnosis apparatus of claim 6, wherein the diagnosis performer determines the diagnosis index safety standards based on the diagnosis index for the plurality of specific periods, and diagnoses a defect of the abnormal safety component by comparing the diagnosis index safety standards with the diagnosis index.

8. The vehicle safety component diagnosis apparatus of claim 7, wherein the diagnosis performer determines that there is a defect in the abnormal safety component when the diagnosis index repeatedly exceeds the diagnosis index safety standards for a specific number of specific continuous periods.

9. A safety component diagnosis method, by a vehicle safety component diagnosis apparatus included in a vehicle and implemented to operate limitedly according to an on/off state of a brake pedal and an accelerator pedal for diagnostic items including an engine, a ball joint, a drive shaft, a wheel bearing, a brake judder, a damper, and a timing belt, comprising:

summarizing a vehicle state based on sensing values collected from a plurality of sensors included in the vehicle for a specific period;

calculating distribution of sensed values corresponding to vehicle states for a plurality of specific periods;

detecting an abnormal safety component by determining an abnormal situation about a specific sensing value through the calculated distribution of the sensed values corresponding to the vehicle states, the abnormal safety component being the drive shaft included in the vehicle;

performing diagnosis about the abnormal safety component; and calculating an enveloping spectrum through envelope analysis for the sensing values of diagnosis parameters related to a knuckle vibration that is a diagnosis part of the driving shaft, wherein distribution safety standards are determined based on distribution about index values and the index values are calculated based on the sensing values in a time domain at every first cycle, diagnosis index safety standards are determined based on distribution of diagnosis indexes and the diagnosis indexes are calculated based on the sensing values in a frequency domain at every second cycle longer than the first cycle, a first sampling cycle of the sensing values for calculating the index values is longer than a second sampling cycle of the sensing values for calculating the diagnosis indexes, and the diagnosis indexes are stored in a memory and the index values and sensing values are deleted from memory to reduce an amount of data stored in the memory.

10. A non-transitory computer-readable medium having embodied thereon a program, which when executed by a vehicle safety component diagnosis apparatus included in a vehicle and implemented to operate limitedly according to an on/off state of a brake pedal and an accelerator pedal for diagnostic items including an engine, a ball joint, a drive shaft, a wheel bearing, a brake judder, a damper, and a timing belt, causes the vehicle safety component diagnosis apparatus to execute a safety component diagnosis method, the method comprising:

summarizing a vehicle state based on sensing values collected from a plurality of sensors included in the vehicle for a specific period;

calculating distribution of sensed values corresponding to vehicle states for a plurality of specific periods;

detecting an abnormal safety component by determining an abnormal situation about a specific sensing value through the calculated distribution of the sensed values corresponding to the vehicle states, the abnormal safety component being the drive shaft included in the vehicle;

performing diagnosis about the abnormal safety component; and calculating an enveloping spectrum through envelope analysis for the sensing values of diagnosis parameters related to a knuckle vibration that is a diagnosis part of the driving shaft, wherein distribution safety standards are determined based on distribution about index values and the index values are calculated based on sensing values in a time domain at every first cycle, diagnosis index safety standards are determined based on distribution of diagnosis indexes and the diagnosis indexes are calculated based on sensing values in a frequency domain at every second cycle longer than the first cycle, a first sampling cycle of the sensing values for calculating the index values is longer than a second sampling cycle of the sensing values for calculating the diagnosis indexes, and the diagnosis indexes are stored in a memory and the index values and sensing values are deleted from memory to reduce an amount of data stored in the memory.

* * * * *